US006292143B1

(12) United States Patent
Romanofsky

(10) Patent No.: US 6,292,143 B1
(45) Date of Patent: Sep. 18, 2001

(54) MULTI-MODE BROADBAND PATCH ANTENNA

(75) Inventor: Robert R. Romanofsky, Hinckley, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/566,839

(22) Filed: May 4, 2000

(51) Int. Cl.[7] ..... H01Q 1/38
(52) U.S. Cl. ..... 343/700 MS
(58) Field of Search ..... 343/700 MS; H01Q 1/38

(56) References Cited

U.S. PATENT DOCUMENTS

| | | | |
|---|---|---|---|
| 5,315,753 | 5/1994 | Jensen | 343/700 MS |
| 5,448,252 | 9/1995 | Ali | 343/700 MS |
| 5,561,435 | 10/1996 | Nalbandian | 343/700 MS |
| 5,589,845 | 12/1996 | Yandrofski | 343/909 |
| 5,694,134 | 12/1997 | Barnes | 343/700 |
| 5,777,581 | 7/1998 | Lilly | 343/700 MS |
| 5,818,391 | 10/1998 | Lee | 343/700 MS |
| 5,838,282 | 11/1998 | Lalezari | 343/727 |
| 5,870,057 | 2/1999 | Evans | 343/700 MS |

OTHER PUBLICATIONS

Bancroft, Randy: "Accurate Design of Dual–Band Antennas", Microwaves and RF, Sep. 1988, pp. 113–118.
Haskins, P. et al: "Active Patch Antenna Element with Diode Tuning", Electronics Letters, vol. 27, No. 20, Sep. 1991, pp. 1846–1847.
Navarro, Julio & Chang, Kai: "Broadband Electronically tunable IC Active Radiating Elements and Power Combiners", Microwave Journal, Oct. 1992, pp. 87–101.
Keily, Edward & Washington, Gregory, & Bernhard, Jennifer: "Design and Development of Smart Microstrip Patch Antennas", Journal of Smart Materials and Structures, vol. 7, 1998, pp.792–800.
Rainville, P.J. & Harackiewicz, F.J.: IEEE Micro Guided Wave letters, vol. 12, No. 2, 1992, pp. 483–485, "Magnetic Tuning of a Microstrip Patch Antenna Fabricated on a Ferrite Film".

*Primary Examiner*—Michael C. Wimer
(74) *Attorney, Agent, or Firm*—Kent N. Stone

(57) ABSTRACT

A multi-mode broad band patch antenna is provided that allows for the same aperture to be used at independent frequencies such as reception at 19 GHz and transmission at 29 GHz. Furthermore, the multi-mode broadband patch antenna provides a ferroelectric film that allows for tuning capability of the multi-mode broadband patch antenna over a relatively large tuning range. The alternative use of a semiconductor substrate permits reduced control voltages since the semiconductor functions as a counter electrode.

44 Claims, 10 Drawing Sheets

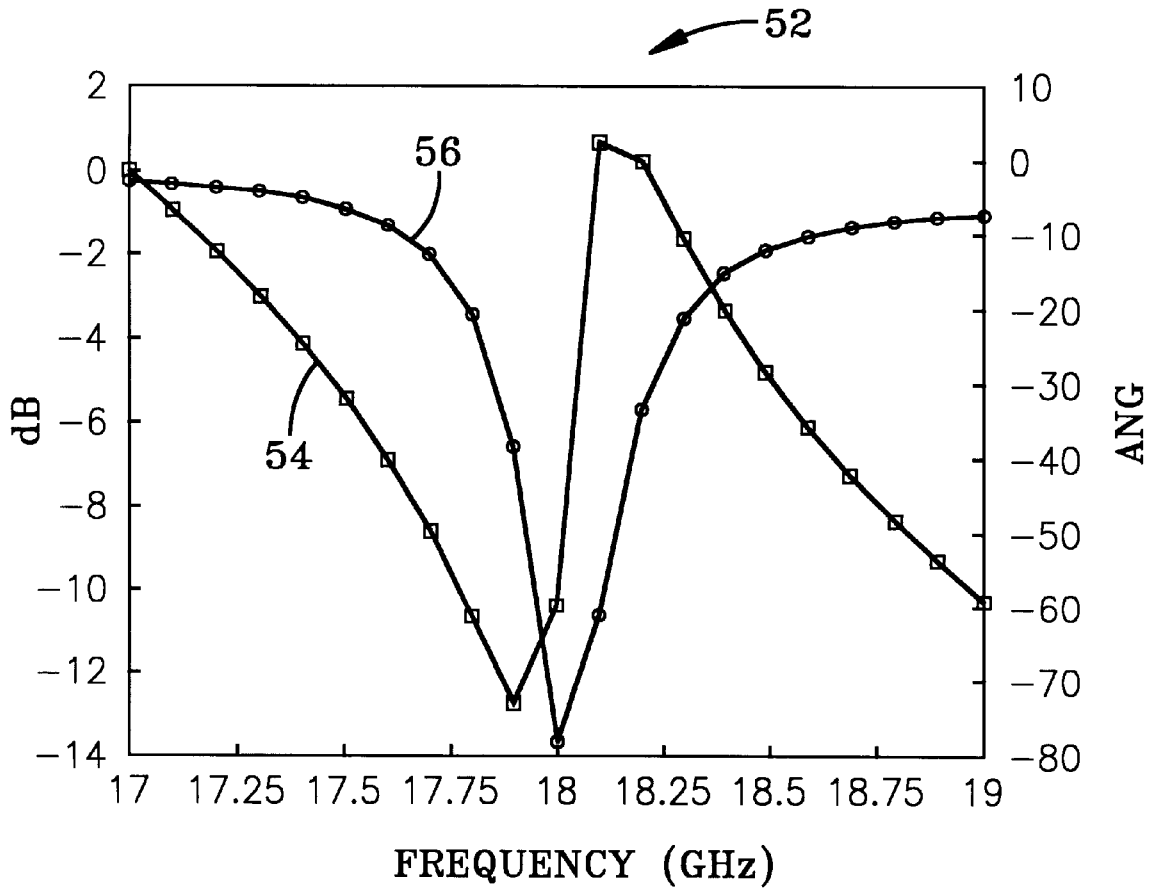
FIG−7

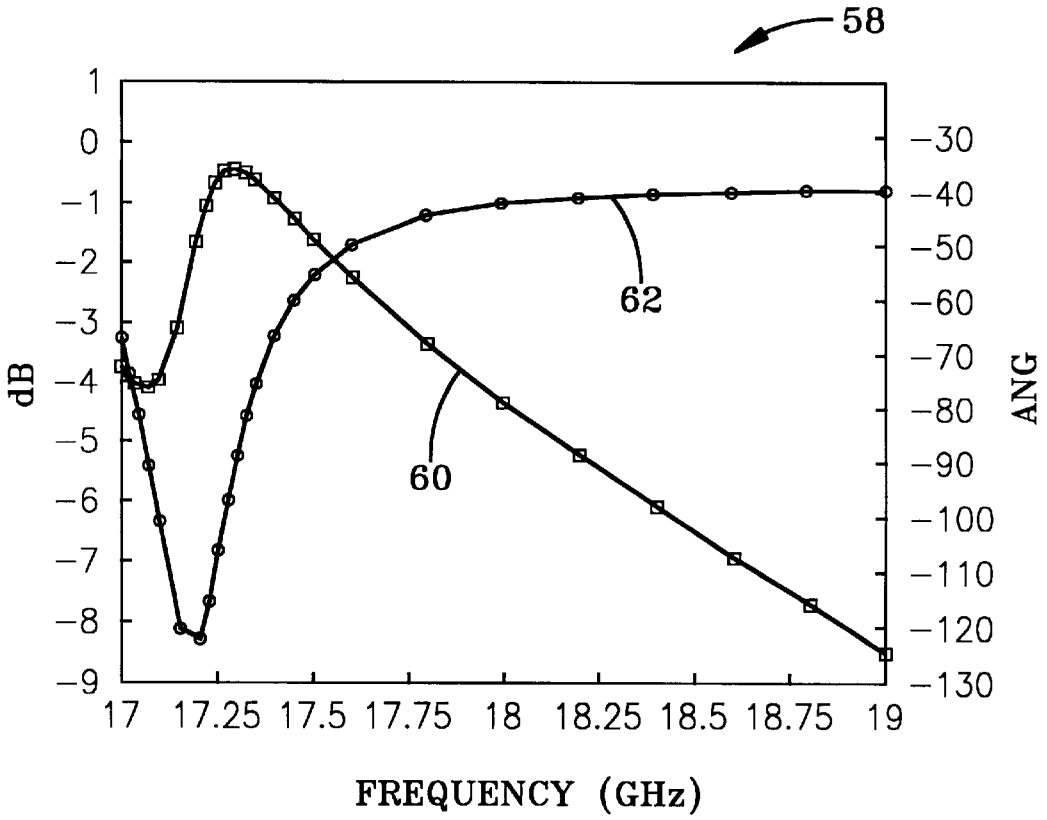
FIG−8
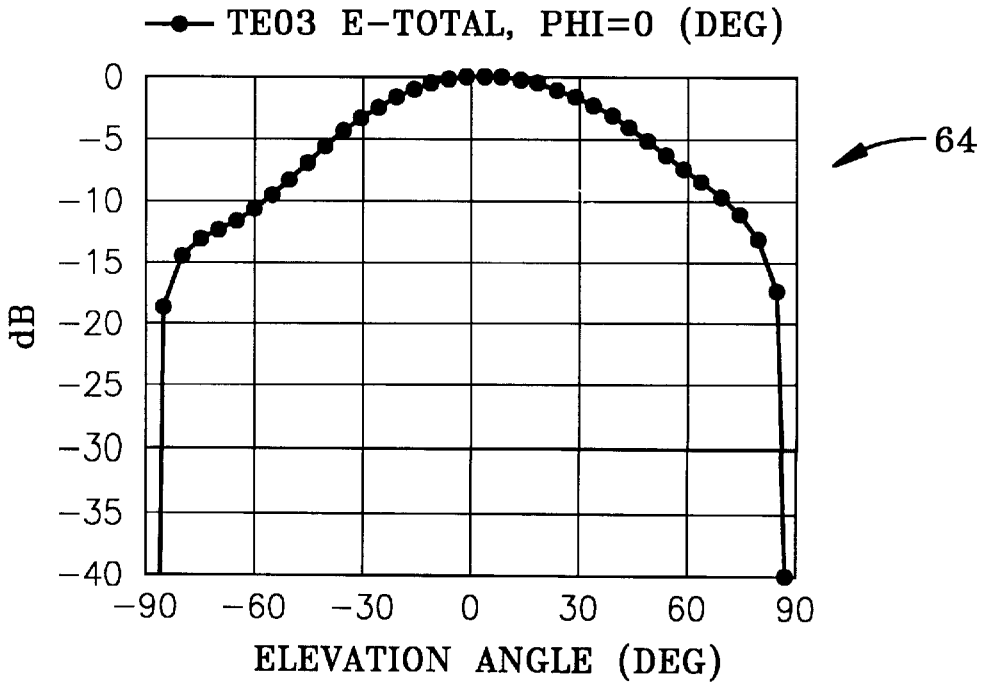
FIG−9

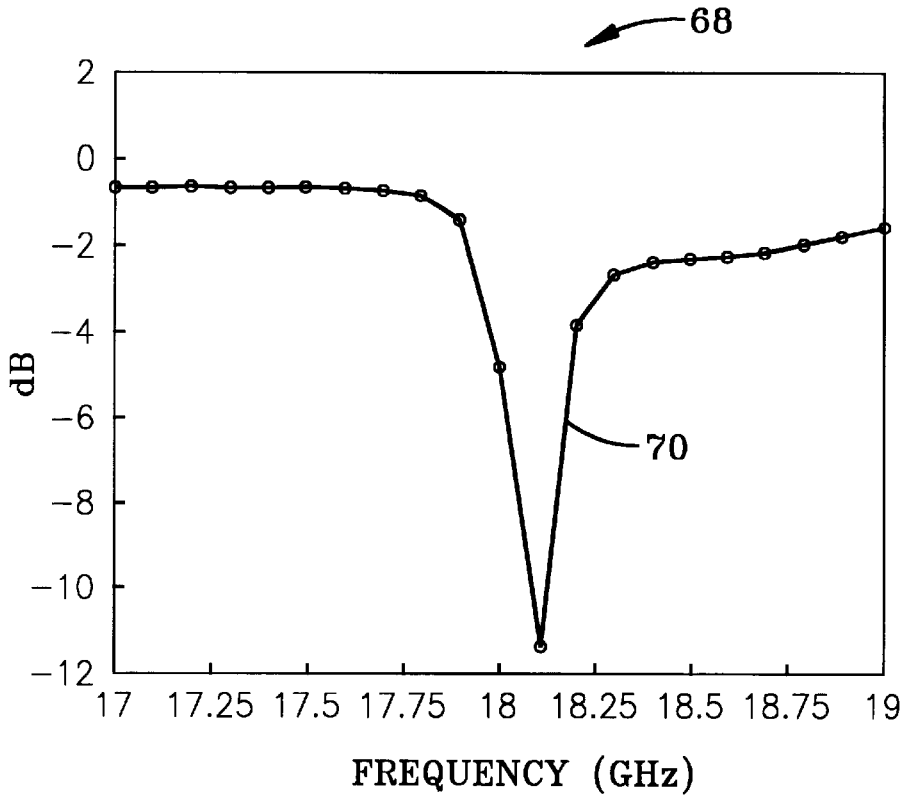
FIG−10
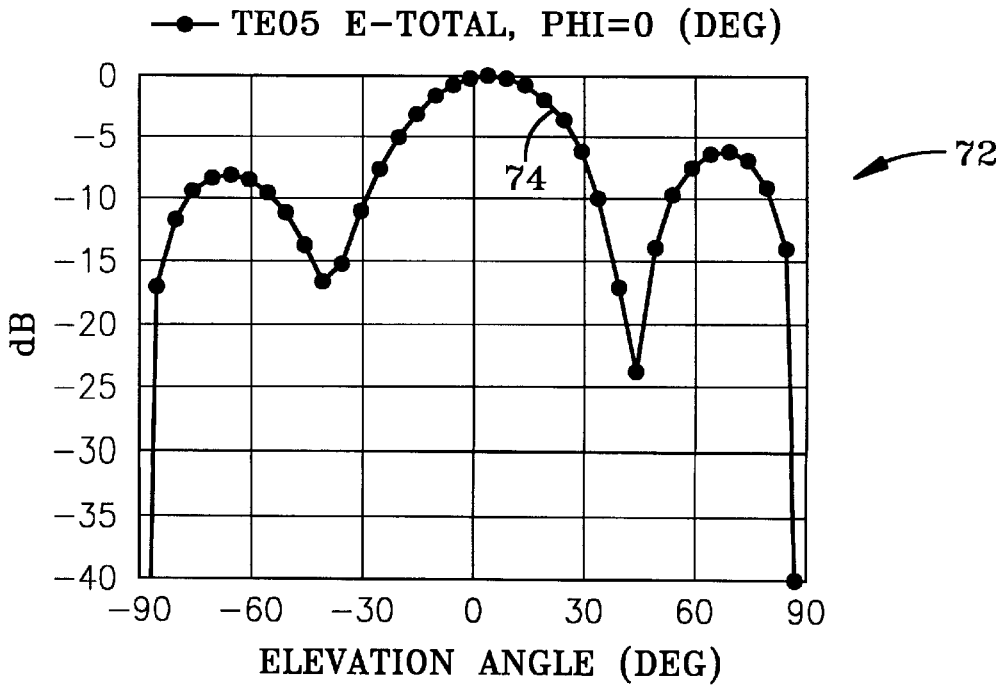
FIG−11

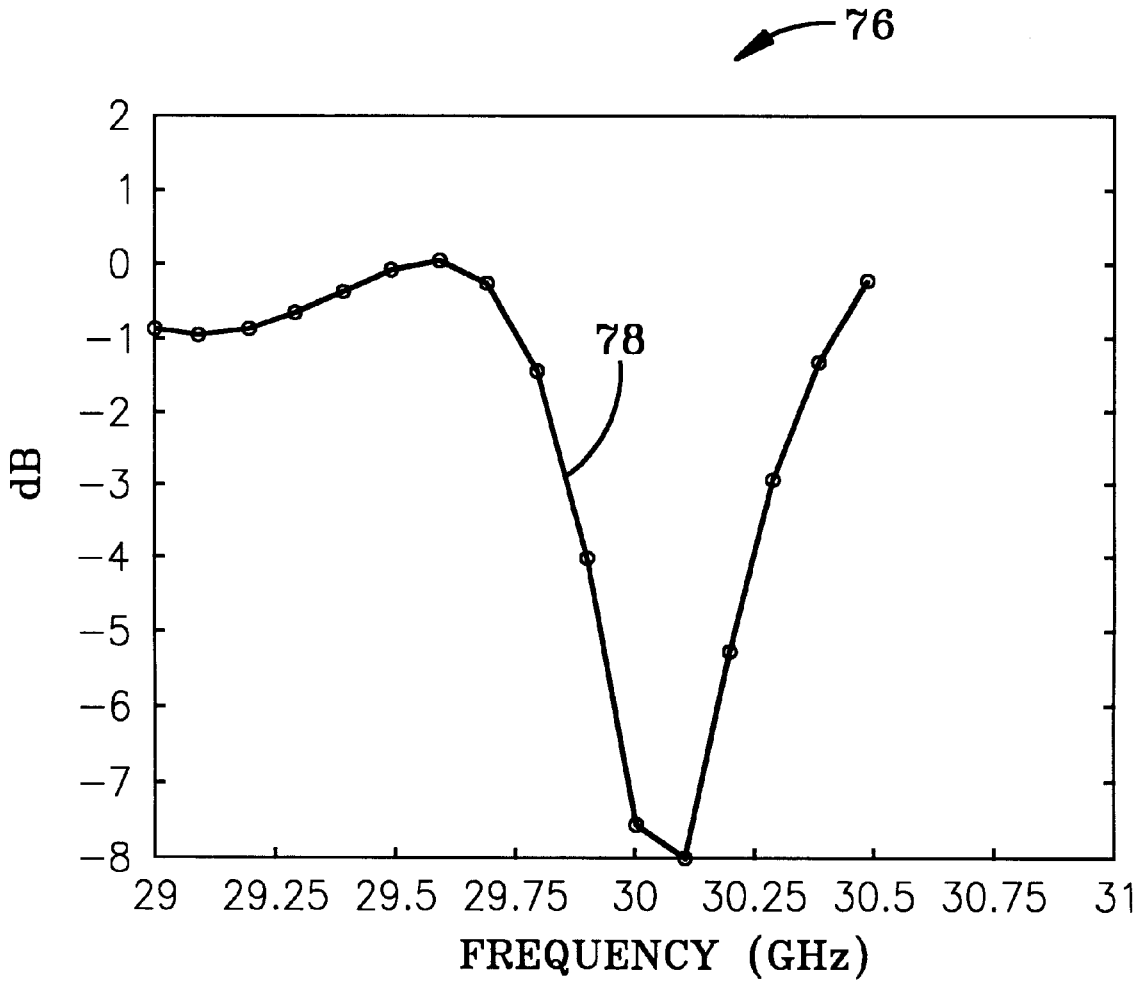
FIG−12

MULTI-MODE BROADBAND PATCH ANTENNA

The invention described herein was made by an employee of the United States Government and may be manufactured and used by or for the Government for governmental purposes without the payment of any royalty thereon or therefor.

FIELD OF THE INVENTION

The present invention relates to patch antennas and, more particularly, to a multi-mode broadband patch antenna that selects the parameters of a radiator so that it operates in an odd-order mode generating a broadside beam and provides tuning by providing a ferroelectric film sandwiched between a substrate and the radiator and by applying a dc field between the radiator and ground plane.

BACKGROUND OF THE INVENTION

Microstrip antennas comprise a radiator element commonly referred to as a patch. Microstrip patch antennas are highly desirable for aerospace applications because they are lightweight, conformal, and inexpensive since they can be produced using conventional lithographic methods. These microstrip patch antennas are becoming increasingly important because of the proliferation of low Earth orbiting communications and remote sensing satellites that generally demand phased array antenna systems advantageously comprised of microstrip patch antennas. Microstrip patch antennas are known and some of which are described in U.S. Pat. Nos. 5,315,753; 5,448,252; 5,561,435; 5,589,845; 5,694,134; 5,777,581; 5,818,391; 5,838,282; and 5,870,057, all of which are herein incorporated by reference. The patch geometry can be square, rectangular, a disk or an annular ring. A major drawback of microstrip antennas is their inherently narrow instantaneous bandwidth, typically 1% or so. Intuitively obvious approaches to enhance bandwidth, such as the use of extremely low permittivity substrates or thick substrates are typically met with an undesirable increase in antenna size or the generation of surface waves that degrade the efficiency of the antennas.

Several approaches are known to increase patch antenna bandwidth. For example, stacked patches have been used to generate dual resonant frequencies. In this approach, a bottom patch is covered with a dielectric layer that serves as the substrate for a top patch. The bottom patch serves as a ground plane for the top patch. Bancroft in a technical article "Accurate Design of Dual-Band Antennas," Microwaves & RF, September, 1988, pp. 113–118, herein incorporated by reference, describes such a bottom patch covered with a dielectric layer and operating at 9 and 11 GHz, a difference of about 20%. Another approach is to use varactor diodes to modify the resonant frequency and is described in a technical article "Active Patch Antenna Element with Diode Tuning," of P. Haskins, P. Hall, and J. Dahele, Electronics Letters, Vol. 27, No. 20, September, 1991, pp. 1846–1847, which is herein incorporated by reference. Haskins et al integrated a diode with a multilayer patch and obtained a 4% tuning range. Navarro and Chang in a technical article "Broadband Electronically Tunable IC Active Radiating Elements and Power Combiners," Microwave Journal, October, 1992, pp. 87–101, herein incorporated by reference, integrated a varactor with a notch antenna and achieved tuning from 8.9 to 10.2 GHz, a range of about 14%. Kiely, Washington, and Bernhard in a technical article "Design and Development of Smart Microstrip Patch Antennas," Journal of Smart Materials and Structures, Vol. 7. pp. 792–800, 1998, herein incorporated by reference, arranged a patch above a parasitic element and varied the separation therebetween by using piezoelectric actuators to shift the frequency. Rainville and Harackiewicz in a technical article IEEE Micro Guided Wave Lett., Vol. 12, no. 2, pp. 483–485, 1992, herein incorporated by reference, describe a patch fabricated on a ferrite film. The application of an in-plane magnetic field onto this ferrite film advantageously tuned the resonant frequency of a cross-polarized field, but not the co-polarized field. The tuning range was 5.86 to 6.03 GHz, about 3%. Although each of these efforts further advanced the art, it is desired that further improvement be made to further increase patch antenna bandwidth so as to enhance their application to both the military and commercial endeavors. Commercial and military applications include low cost tracking terminals to advantageously complement the forthcoming wideband low Earth orbiting satellite constellations and stealthy communications and radar systems.

OBJECTS OF THE INVENTION

It is the primary object of the present invention to provide for a patch antenna having a bandwidth that is maintained about a selectable frequency and which can be tuned over a relatively broad frequency range.

It is another object of the present invention to provide for a broadband patch antenna that can be used for reception at a selected individual frequency, such as 19 GHz, and transmission at another individually selected frequency, such as 29 GHz.

It is still another object of the present invention to provide for a broadband patch antenna that may be fabricated in a relatively inexpensive manner, such as by using conventional photolithography similar to that use for semiconductors and printed circuits.

It is a further object of the present invention to provide for a broadband patch antenna having an odd-order mode of operation generating a broadband beam, and also allowing for tuning by applying a dc voltage between the radiating element and ground plane.

It is a still further object of the present invention to provide a ferroelectric film having a dielectric constant which is a function of the voltage applied across the film so as to modify the dielectric constant and correspondingly adjust the apparent electrical length of the broadband patch antenna.

SUMMARY OF THE INVENTION

This invention is directed to a broadband patch antenna that can transmit or receive at two essentially independent frequencies, while at the same time has tuning capabilities to vary the selected frequency over a predetermined frequency range.

A tunable microstrip patch antenna element is provided and comprises a ground plane comprised of a conductive material, a substrate comprised of a dielectric or semiconductive material which is mounted on the ground plane, a radiator, and a ferroelectric film. The radiator has an apparent electrical dimension and has parameters that are selected so as to operate in a fundamental mode at an odd-order common denominator of desired operating frequencies. The radiator has a circuit for connecting to means for generating a dc electric field between the radiator and the ground plane. The ferroelectric material is placed on the substrate, and in cooperation with the substrate, is deterministic of the apparent dimension of the radiator.

BRIEF DESCRIPTION OF THE DRAWINGS

For a better understanding of the nature and objects of the present invention, reference should be made to the following detailed description taken in conjunction with the accompanied drawings, in which like parts are given like reference numbers, and wherein:

FIG. 6(*b*) illustrates the antenna elements of FIG. 1 placed in a two-dimensional array to form an antenna system;

FIG. 6(*c*) illustrates the placement of the antenna elements of FIG. 1 on to a curved surface;

FIG. 7 illustrates a response representative of the input reflection coefficient of one embodiment of a multi-mode antenna element of the present invention;

FIG. 8 illustrates a response representative of the input reflection coefficient of the multi-mode patch antenna system having a dielectric tuned constant which is different than that of FIG. 7;

FIG. 9 illustrates a E-field pattern associated with operating the multi-mode patch antenna at one of its odd-modes of operation;

FIG. 10 illustrates the return loss response associated with operating the multi-mode patch antenna of FIG. 9;

FIG. 11 illustrates a E-field pattern associated with operating the multi-mode patch antenna in another mode of operation which is different than that of FIG. 9; and FIG. 12 illustrates the return loss response associated with operating a multi-mode patch antenna of FIG. 11.

DETAILED DESCRIPTION OF THE PREFERRED EMBODIMENTS

Figure 1:
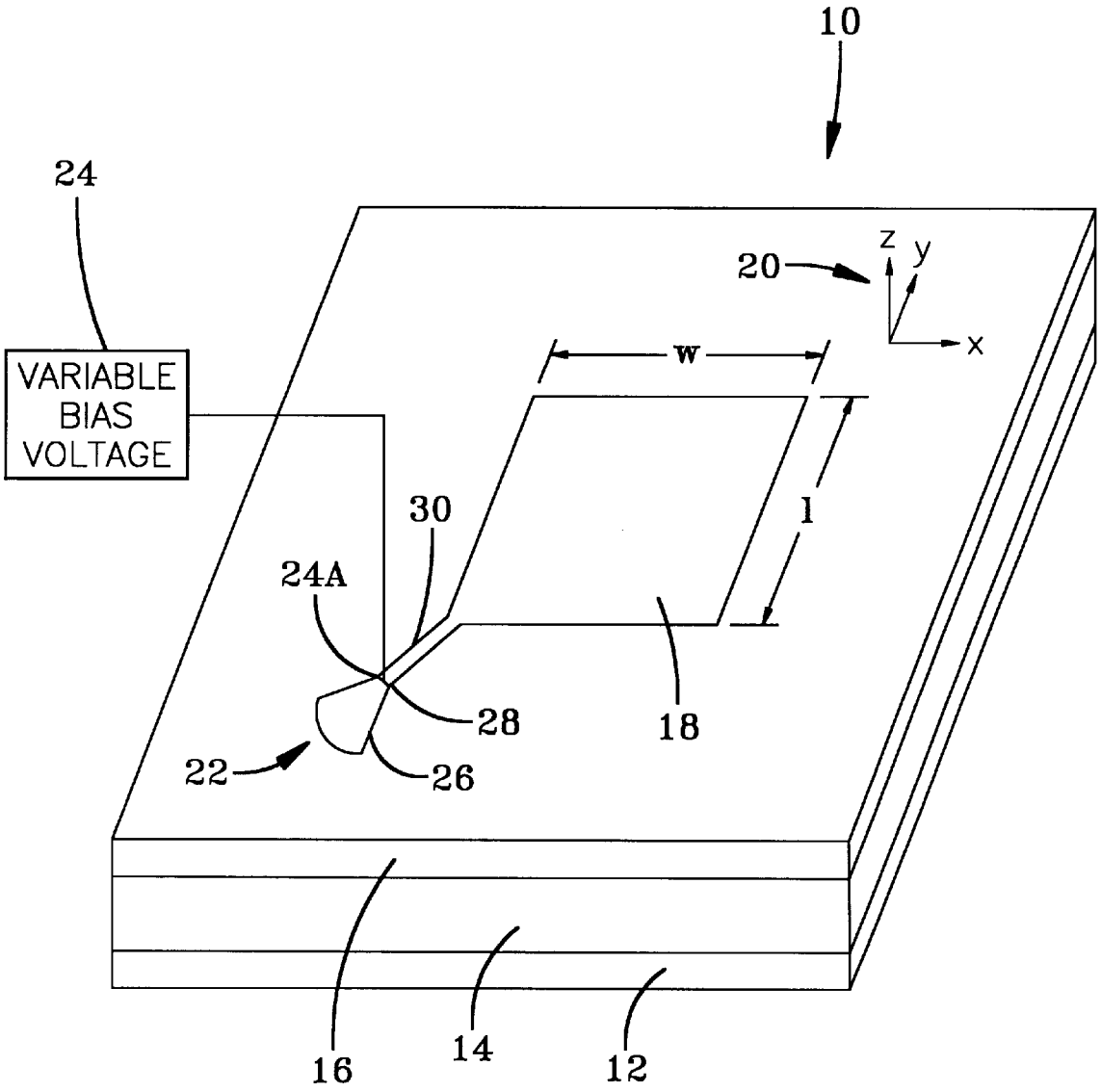
FIG. 1 is a schematic drawing of one embodiment of the multi-mode patch antenna of the present invention.

Referring to the drawings, FIG. 1 illustrates a tunable multi-mode broadband patch antenna having a single aperture that can transmit or receive at two essentially independent frequencies and also has the ability to be tuned over a relatively broad frequency range. Tunability is provided by a thin (i.e. <<corresponding wavelength) ferroelectric film having a dielectric constant which is a function of the voltage applied across the film and the modification of the dielectric constant adjusts the apparent electrical dimension of the tunable microstrip patch antenna element 10.

The multi-mode broadband patch antenna 10 comprises a ground plane 12 comprised of a conductive (i.e. metallic or superconductive) material, a substrate 14 comprised of a dielectric or semiconductive material mounted on the ground plane 12, a ferroelectric film 16 grown on the substrate 14, and a radiator 18 sometimes referred to herein as a patch or an aperture. As used herein, the word "aperture" refers to the radiator 18 through which a major portion of the radiation associated with the antenna passes. Further as used herein, the tunable multi-mode broadband patch antenna may be interchangeably referred to as a tunable microstrip antenna. Further, the tunable multi-mode broadband patch antenna 10 of FIG. 1 is actually only an element that may be arranged into various antenna systems to be further described with reference to FIGS. 6(*a*), 6(*b*), and 6(*c*).

The ground plane 12 preferably serves as a bottom surface of the multi-mode patch antenna 10 and is usually comprised of copper, but other electrically conductive materials, known in the art, may be used.

The substrate 14 is comprised of a dielectric substrates formed of materials like ceramics (quartz, aluminum, etc.) or polymers (Teflon™ serving as synthetic fluoride containing resins) or semiconductors (silicon, etc.) and is preferred to be of a material selected from the group consisting of $LaAlO_3$, MgO and Si. The substrate 14 is preferably a thick layer (e.g. a mil or more in thickness).

The ferroelectric film 16 is preferably a thin film (e.g. 1 $\mu$m in thickness) and is preferably selected from the group of materials consisting of $SrTiO_3$, $Ba_{1-x}Sr_xTiO_3$, or other perovskite and non-perovskite ferroelectrics known in the art. The ferroelectric material 16 can be grown onto the dielectric substrate 14 by using numerous methods, all known in the art, such as laser ablation, combustion chemical vapor deposition, and sol-gel. Furthermore, the remaining elements of the multi-mode patch antenna 10 can be produced using conventional photolithography techniques similar to that used in printed circuit or semiconductive device technology.

The radiator 18 has an apparent electrical dimension and its parameters are selected to operate in a fundamental mode which is an odd order common denominator of a desired frequency in a manner to be further described. The apparent electrical dimension comprises the width (w) and length (l) parameters as shown in FIG. 1. The radiator 18 preferably serves as the top surface of the multi-mode patch antenna, and may be fabricated by vacuum evaporation directly onto the ferroelectric film 16. The radiator 18 is comprised of a metallic material and may be selected to have various configurations or shapes that include squares, rectangles, circles and triangles. The radiator 18 is arranged on the top surface of the multi-mode patch antenna 10 along the x-y-z-axes orientation 20 shown in FIG. 1. The radiator 18 also cooperatively operates with a circuit 22 which is connected to means 24 for generating a dc electric field between the radiator 18 and the ground plane 12 and as shown as being a variable bias voltage 24.

The circuit 22 takes the form of tee (T) and comprises a quarter-wavelength radial stub 26, known in the art, having a vertex 28 which is connected to the radiator 18 by high impedance microstrip transmission line 30. The radiator 18, by way of the microstrip transmission line 30, is connected to the variable bias voltage 24 by a wire bond 24A. The input impedance network as seen by the radiator 18, is comprised of a series combination consisting of the high impedance microstrip transmission line 30 and the stub 26. The wire bond 24A is attached to the vertex 28 so as not to perturb the impedance. This input impedance is relatively high (e.g. >>50 ohms) and allows for successful operation of the dc electric field modifying, to be described, the dielectric constant of the ferroelectric film 16 over a broadband of frequencies, such as an octave of bandwidth.

The radial stub 26 is designed at mid-band between the desired operating frequencies (to be described) and consequently is physically small compared to the radiator 18. More particularly, the stub 26 and high impedance line 30 lengths are selected to appear as an open circuit to the antenna around the operating frequencies. The wire bond 24A delivers the variable bias voltage 24 to a virtually short location on the radial stub 26, so that the input impedance of the radiator 18 is not perturbed. Furthermore, since the dc resistances of ferroelectric material 16 and the dielectric substrate 14 are relatively large, the power supply, included as part of the variable bias voltage 24, may be relatively simple and inexpensive, despite the need to supply relatively high dc electric fields from the variable bias voltage 24 to the multi-mode patch antenna 10. Such operations require only microamperes ($\mu$A) of current. An alternative embodiment 10A of the multi-mode broadband patch antenna of the present invention may be described with reference to FIG. 2.

Figure 2:
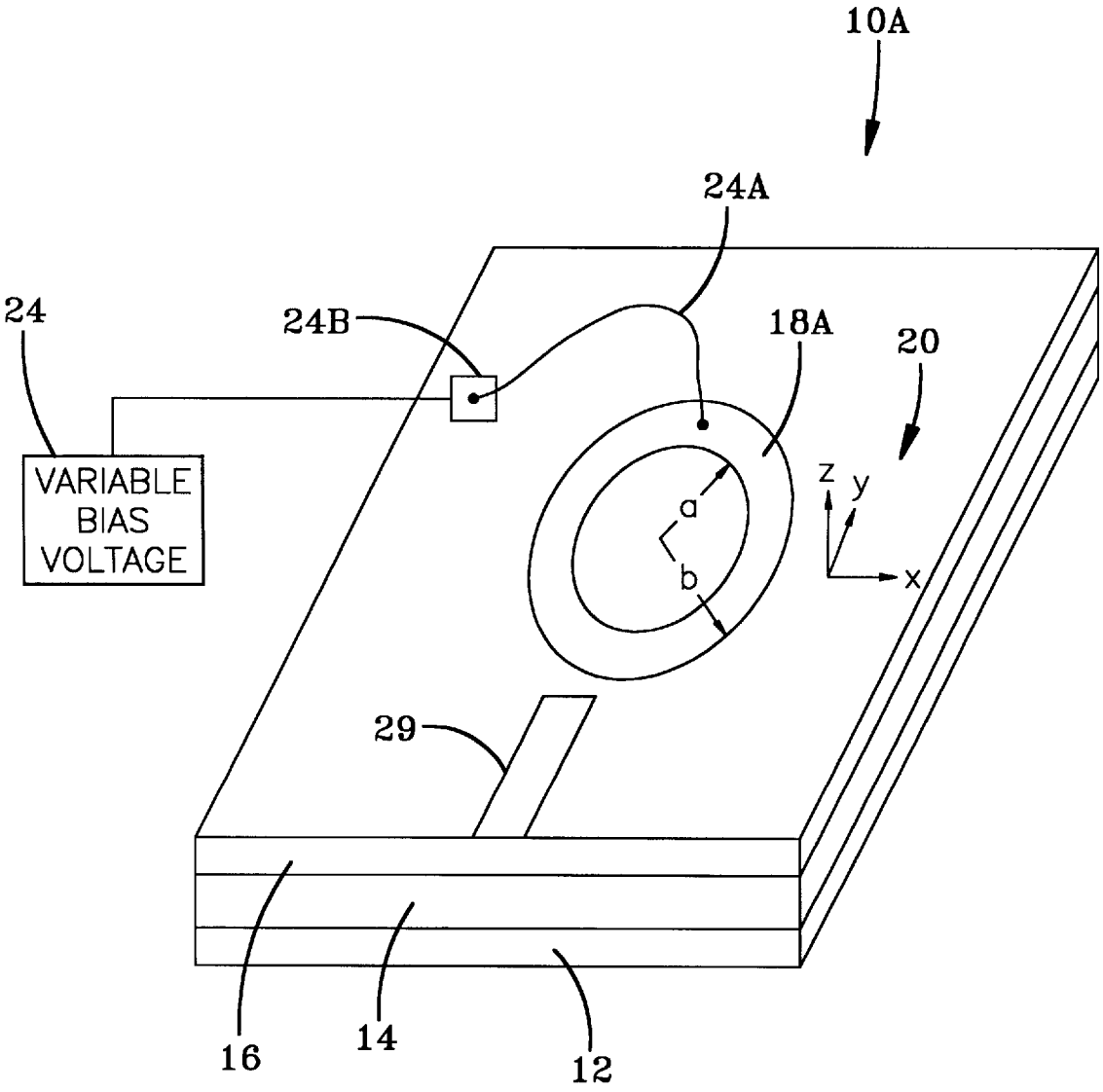
FIG. 2 is a schematic drawing of an alternate embodiment with bias means attached to a virtual short circuit on the patch.

FIG. 2 illustrates an annular ring radiator 18A having dimensions a and b which are the inner and outer radii, respectively. It is a property of the annular ring 18A that numerous non-harmonically related modes can be generated. Wire bond 24A, shown as connected to a junction 24B, is attached to a virtual short circuit potential for the $TM_1$ and $TM_3$ modes to be further described. The broadband patch antenna 10A further comprises a microstrip 29 which may be further described with reference to FIG. 3 showing a still further embodiment 10B.

Figure 3:
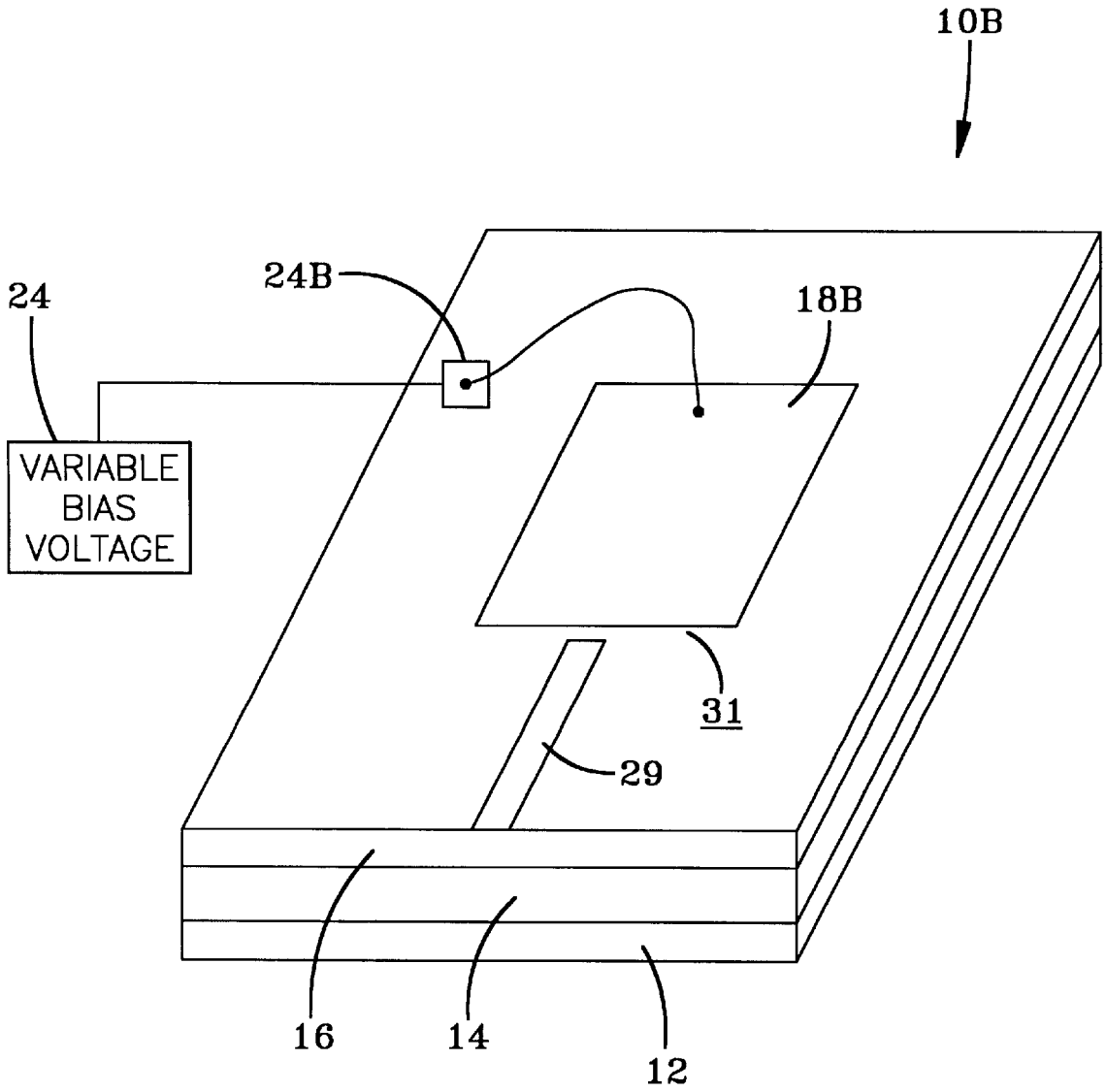
FIG. 3 illustrates a capacitive coupling arrangement used to extend the bandwidth of the multi-mode patch antennas of the present invention.

The embodiment 10B of FIG. 3 is similar to the embodiment 10A of FIG. 2, except that embodiment 10B has a rectangular shaped radiator 18B and, more importantly, a capacitive coupling arrangement 31 having spaced apart radiator 18B and the microstrip 29 that is used to extend the bandwidth, in a manner known in the art, of the multi-mode patch antenna 10B of FIG. 3. Furthermore, the microstrip 29, in operative cooperation with the annular ring radiator 18A, extends the bandwidth of the multi-mode antenna 10A of FIG. 2 and may also be used in a similar manner to the multi-mode antenna 10 of FIG. 1. The radiators 18, 18A and 18B in their operation may be excited in a manner that may be further described with reference to FIG. 4.

Figure 4:
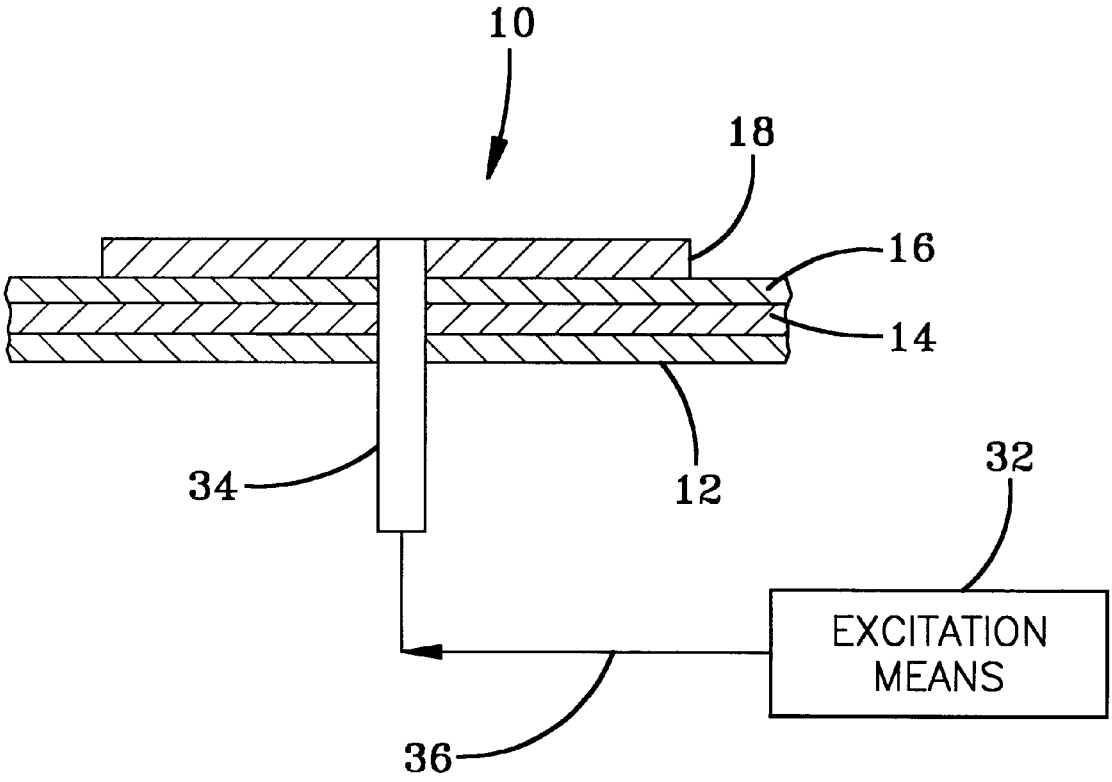
FIG. 4 illustrates a feed line applied to the patch antenna of the present invention.

Although not shown, the arrangement of FIG. 4 is equally applicable for its operational cooperation for the embodiments of FIGS. 2 and 3. FIG. 4 generally illustrates excitation means 32 connected to the multi-mode patch antenna 10 of FIG. 1. The excitation means 32 generates the fields used by the present invention to establish predetermined transverse magnetic modes (TM) to be further described. The excitation means 32, a probe 34, and a signal path 36, introduce energy into the multi-mode patch antenna 10, more particularly, to the radiator 18. The excitation means 32 is connected to the probe 34 by way of signal path 36. In one embodiment, related to non-circular polarization, the probe 24 enters the central region of the ground plane 12 and passes into the ground plane 12 and vertically up through and out of the substrate 14 and then into the radiator 18, as shown in FIG. 4. A further embodiment for exciting the multi-mode patch antenna 10 may be further described with reference to FIG. 5.

Figure 5:
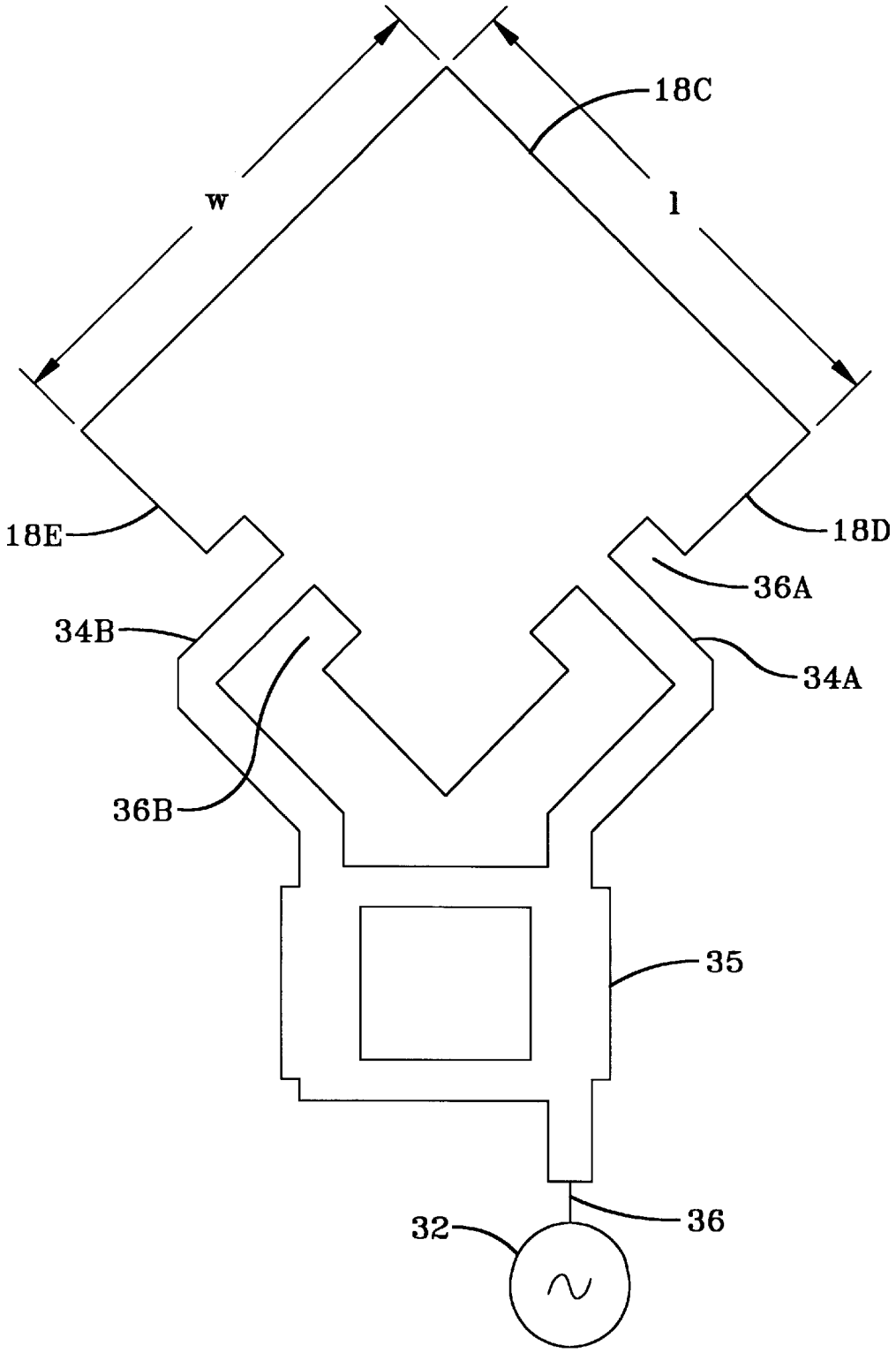
FIG. 5 illustrates a feed line that provides for circular polarization for the multi-mode patch antenna of the present invention.

FIG. 5 illustrates an arrangement having a radiator 18C and in which the electric and magnetic fields of the electromagnetic waves are provided from the excitation means 32 so as to rotate the fields in a circular manner, referred to as circular polarization. For such circular polarization, the width (w) and the length (l) of the radiator 18C are preferably selected so as to be substantially equal to each other and the feed arrangement of FIG. 5 is constructed so as to excite the orthogonal edges 18D and 18E of the radiator 18C with excitation which is 90 degrees out of phase relative to each other, that is, each of the orthogonal edges 18D and 18E by use of a quadrature coupler 35.

As seen in FIG. 5, two microstrips 34A and 34B are respectfully inserted in to each of the orthogonal edges 18D and 18E, and the microstrips 34A and 34B may enter through inserts 36A and 36B for impedance matching purposes.

The multi-mode patch antenna 10, 10A and 10B may be arranged into various antenna systems each including a plurality of a multi-mode patch antenna elements and may be further described with reference to FIGS. 6(*a*), 6(*b*), and 6(*c*) which illustrate the use of antenna element 10, although antenna elements 10A and 10B are equally applicable for such systems.

Figure 6A:
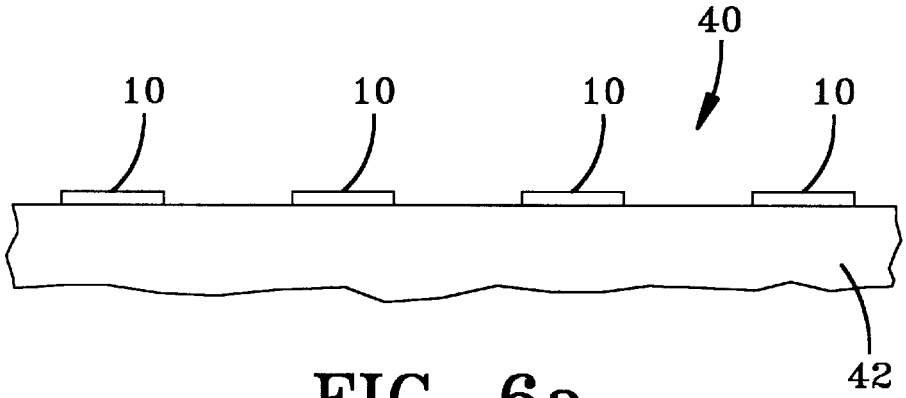
FIG. 6(*a*) illustrates the antenna elements of FIG. 1 placed in a one-dimensional array to form an antenna system.
Figure 6B:
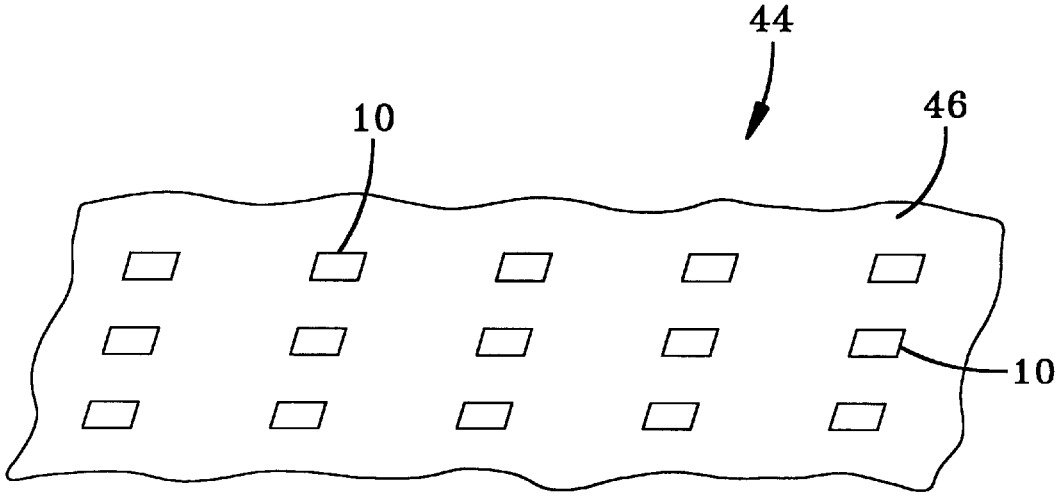
Figure 6C:
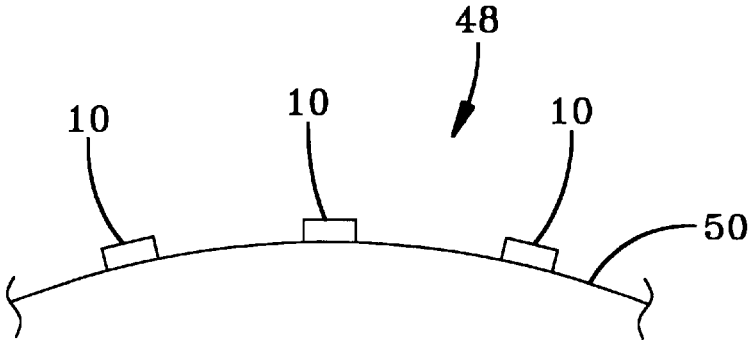

FIG. 6(*a*) illustrates a antenna system 40 comprised of a plurality of multi-mode patch antenna elements 10 arranged on to a surface 42, and into a one-dimensional array.

FIG. 6(*b*) illustrates a system 44 comprised of a plurality of multi-mode patch antenna elements 10 arranged on to a surface 46, and into a two-dimensional array.

FIG. 6(*c*) illustrates a system 48 comprised of a plurality of multi-mode patch antenna elements 10 arranged on to a curved surface 50.

The present invention selects parameters to produce a desired transverse magnetic (TM) mode and to establish the fundamental frequency of operation of the multi-mode patch antenna, in particular, the radiator 18, 18A, 18B or 18C. Further, the present invention provides for a ferroelectric material 16 whose dielectric constant varies in accordance with the dc electric field generated by the variable bias voltage 24 and applied between the radiator 18, 18A, 18B or 18C and the ground plane 12 so that the overall dielectric constant, comprised of the combination of the ferroelectric film 16 and the substrate 14, is tuned to a particular value which, in turn, determines the apparent length of the radiator 18, 18A, 18B or 18C which, in turn, determines the fundamental frequency at which the radiator 18, 18A, 18B or 18C radiates electromagnetic energy.

The lowest order TM mode ($TM_{01}$) of the operation of the radiator 18, 18A, 18B or 18C is established by selecting the length (l) of the radiator 18, 18A, 18B or 18C to be about one-half (½) wavelength long at the selected fundamental frequency. It should be noted that the common denominator TM mode is an odd order value of the fundamental frequency and is shown as the n designation (Y-direction) of the TM mode. The width (w) of the radiator is chosen to optimize performance. More particularly, narrow widths (w), that is those less than for the length (l) of the radiator 18, 18A, 18B or 18C reduce efficiency, whereas widths (w) greater than twice the length of the radiator generate higher order TM modes of operation. For circular polarization, previously discussed with reference to FIG. 5, the widths (w) and length (l) parameters are preferably selected to be equal to each other.

With regard to the tuning capability of the multi-mode patch antenna, it is known that the dielectric constant of a thin film $SrTiO_3$, can be varied from 3500 to 500 when a dc electrical field strength of 0 and 15 kV/cm is respectively applied thereacross. The variability of the dielectric constant of the thin ferroelectric film 16 in response to the dc electric field and in combination with the non-variable dielectric constant of the substrate 14 provides an overall effective dielectric constant for the multi-mode patch antenna element 10.

Table 1 illustrates the dynamic dielectric constant of the ferroelectric film 16, the overall effective dielectric constant of the antenna element 10, and the required dc fields to ferroelectric film 16 composed of $SrTiO_3$ and having a thickness of 2 $\mu$m and for a dielectric substrate 14 composed of $LaAlO_3$ and having a thickness of 0.25 mm. The effective dielectric constant ($\in_{eff}$) may be defined as:

$$\in_{eff}=(\tfrac{1}{2}(\sqrt{\in r_{even}}+\sqrt{\in r_{odd}}))^2$$

Where $\in r_{even}$ and $\in r_{odd}$ are even and odd mode dielectric constants, respectively, as defined in the technical article of Romnofsky and Qureshi, IEEE Intermag 2000, Toronto, April, 2000 "A Theoretical Model for Thin Film Coupled Microstripline Phase Shifters", and rated by reference.

TABLE 1

| Dielectric Constant of Ferroelectric Film 16 | Overall Effective Dielectric Constant of the Antenna element 10 |
|---|---|
| 300 | 18.43 |
| 600 | 21.00 |
| 900 | 23.09 |
| 1200 | 24.93 |
| 1500 | 26.59 |
| 1800 | 28.12 |

From Table 1 it may be seen that the effective dielectric constant changes as the ferroelectric film 16 is tuned, that is, as the dc electric field is varied. The corresponding tuning voltages range from ≈0 Kv/cm at the upper dielectric constant to near the dielectric breakdown voltage of the films ≈500 Kv/cm, at the low dielectric constant.

The results shown in Table 1 for a multi-mode patch antenna element of the present invention is based on a quasi-TEM variation method known in the art. Depending on a number of parameters, such as those (w and l) of the radiator 18,18A, 18B or 18C, as the dielectric constant of the ferroelectric film 16 is tuned past a value of ≈1500, the imput impedance of the multi-mode patch antenna of the present invention, that is, the input impedance of the radiator 18, 18A, 18B or 18C becomes entirely inductive and the radiator of the present invention ceases to radiate electromagnetic waves rendering the multi-mode patch antenna of the present invention inoperative.

The results of tuning the multi-mode patch antenna of the present invention operated in a $TM_{03}$ mode near a 18 GHz frequency based on a full wave electromagnetic simulation are illustrated in FIGS. 7 and 8.

FIG. 7 illustrates a response 52 comprised of two plots 54, and 56, wherein plot 54 indicates the input reflection coefficient angle and plot 56 indicates the input reflection coefficient magnitude. The response 52 represents the input impedance coefficient associated with a square radiator 18 being placed on a ferroelectric film having a thickness of 0.5 micrometers ($\mu$m) which, in turn, is placed on a dielectric substrate 14 that has a thickness of 0.0305 cm as is comprised of MgO. The input reflection coefficient is that associated with the utilization of a ferroelectric film 16 having a dielectric constant of 300 which is achieved by subjecting the ferroelectric film 16 to a dc electric field approaching 500 kV/cm applied thereacross.

FIG. 8 illustrates a response 58 comprised of plots 60 and 62, wherein plot 60 represents the input reflection coefficient angle and plot 62 represents the input reflection coefficient magnitude. The plot 58 represents the input coefficient of multi-mode patch antenna of the present invention having the same parameters as that of the element of FIG. 7, but with exception that the ferroelectric film is tuned so as to have a dielectric constant of 1,500 by the application of a dc electric field approaching 0 kV/cm.

From the practice of the present invention it was determined that there is a strong correlation between the ferroelectric film 16 and the desired tuning for the multi-mode patch antennas of the present invention. More particularly, beyond roughly a thickness of 1 micrometer, the quality, that is, crystallinity of the ferroelectric film 16 deteriorates and the advantage of thick film for substrate 14 diminishes. Specifically, the use of thick film for the substrate 14 provides additional tuning range and when film quality diminishes the performance of the multi-mode patch antenna element suffers. The preferred film thickness is of order 0.7 micrometers.

From FIGS. 7 and 8, it is seen that plots 54, 56, 60, and 62 provide a tunable bandwidth of 5 percent (5%).

From the further practice of the present invention, it was determined by choosing the proper fundamental mode, the multi-mode patch antenna of the present invention can be made to resonant at a frequency with a broadside beam over a wide frequency range. For example, by designing the multi-mode patch antenna to operate in the $TM_{01}$ mode at a frequency of 6.0665 GHz, the multi-mode patch antenna of the present invention can be tuned to operate in higher order modes at both approximately 18 GHz ($TM_{03}$) and approximately 30 GHz ($TM_{05}$) For this example, the dielectric substrate 14 was selected to be of a 0.457 cm thick silicon, and the length (l) and width (w) of the radiator, such as radiator 18, was chosen as l=w=0.72 cm. The theoretical radiation characteristics and the return loss for the $TM_{03}$ mode of operation may be further described with reference to FIG. 9 having a response 64.

The response 64 represents the total E-pattern of the $TM_{03}$ mode with the fundamental frequency selected to be 18.1 GHz.

FIG. 10 illustrates a response 68 comprised of a plot 70 representative of the return loss associated with a radiator 18 selected to operate in the $TM_{03}$ mode with the associated frequency being 18.1 GHz.

FIG. 11 illustrates a response 72 having a plot 74 representative of the total E-pattern of the $TM_{05}$ mode with the fundamental frequency selected to be 30.1 GHz.

FIG. 12 illustrates a response 76 comprised of a plot 78 representative of the return loss associated with a multi-mode patch antenna 10 operated in the $TM_{05}$ mode with the fundamental frequency selected to be 30.1 GHz.

From FIGS. 9–12, it is seen that a single aperture described by the present invention can function in multiple modes to provide dual frequency operation and can consequently be used for transmission and/or receive operation in different frequency bands. The use of a silicon substrate 14 as depicted in FIGS. 9–12, is advantageous because of the semiconductor properties of silicon. For example, using high resistivity silicon ($1000 \leqq p \leqq 10000$, ohm-cm) a high quality substrate is realized and tuning voltage reduced since the silicon substrate 14 behaves as the counter or biasing electrode for the ferroelectric film 16. More particularly, silicon is partially conductive and hence the substrate 14 containing silicon can be used as a biasing electrode for the ferroelectric film 16. This reduces the physical distance between electrodes thus reducing the total voltage needed to operate the multi-mode patch antennas of the present invention. The resistivity of the silicon is chosen judiciously so as to be a good electrode and a good antenna substrate. A resistivity between 1000 and 10000 ohm-cm is preferred.

It should now be appreciated that the practice of the present invention provides for a multi-mode patch antenna having an aperture that operates at essentially independent frequencies spanning several octaves. The cooperative operation of the ferroelectric film 16 and the dielectric substrate 14, in response to the application of a dc electric field across the ferroelectric film 16, allows the multi-mode patch antenna of the present invention to be tuned over a relatively wide frequency band.

It is to be understood that the invention is not limited to specific embodiments herein illustrated and described, but may be otherwise without departing from the sphere and scope of the invention.

What I claim is:

1. A tunable microstrip patch antenna element comprising;

a ground plane comprised of a conductive material;

a substrate comprised of a material selected from the group consisting of dielectric and semiconductive materials and mounted on said ground plane;

a radiator having an apparent electrical dimension and with parameters selected so as to operate in a fundamental mode at an odd order common denominator of desired fundamental frequencies, said radiator having a circuit for connecting to a variable bias voltage comprising means for generating a dc electric field between said radiator and said ground plane; and a ferroelectric film placed on said substrate and in cooperation with said substrate being deterministic of said apparent electrical dimension of said radiator.

2. The tunable microstrip patch antenna element according to claim 1, wherein said radiator comprises an annular ring.

3. The tunable microstrip patch antenna element according to claim 1, wherein said substrate is comprised of silicon.

4. The tunable microstrip patch antenna element according to claim 3, wherein said silicon has a resistivity in the range from about 1000 ohm-cm to about 10,000 ohm-cm.

5. The tunable microstrip patch antenna element according to claim 1, further comprising a capacitive coupling arrangement comprising a microstrip spaced apart from said radiator.

6. The tunable microstrip patch antenna element according to claim 1, wherein said circuit comprises a quarter-wavelength radial stub having a vertex which is connected by a high impedance microstrip transmission line to said radiator and to said means for generating said electric field.

7. The tunable microstrip patch antenna element according to claim 6, wherein said means for generating said dc electric field is connected to said radiator by a wire bond.

8. The tunable microstrip patch antenna element according to claim 7, wherein said means for generating said dc electric field is variable.

9. The tunable microstrip patch antenna element according to claim 1, wherein said tunable microstrip patch antenna element has a desired fundamental frequency and said fundamental mode is $TM_{01}$ with said apparent dimension comprises a length (l) of said radiator which is one-half (½) wavelength long at the desired fundamental frequency.

10. The tunable patch antenna according to claim 2, wherein said annular ring is operated in a selectable $TM_{nm}$ mode.

11. The tunable microstrip patch antenna element according to claim 1, wherein said ferroelectric film is a thin film.

12. The tunable microstrip patch antenna element according to claim 1, wherein said ferroelectric film is a material selected from the group consisting of $SrTiO_3$, $Ba_{1-x}Sr_xTiO_3$ and other perovskites and ferroelectrics.

13. The tunable microstrip patch antenna element according to claim 1, wherein said dielectric substrate is a thick layer.

14. The tunable microstrip patch antenna element according to claim 1, wherein said substrate is a material selected from the group consisting of $LaAlO_3$, MgO and Si.

15. The tunable microstrip patch antenna according to claim 1, wherein said radiator is of a metallic material and has a desired shape.

16. The tunable microstrip patch antenna element according to claim 15, wherein said tunable microstrip patch antenna element has a desired fundamental frequency and said fundamental mode is $TM_{01}$ with said apparent electrical dimension comprising a length of said radiator which is one-half (½) wavelength long at the desired fundamental frequency.

17. The tunable microstrip patch antenna element according to claim 1, wherein said substrate comprises a material of $LaAlO_3$ having a thickness of about 0.25 mm and said ferroelectric film has a thickness of about 2 $\mu$m and is comprised of a material comprising $SrTiO_3$.

18. The tunable microstrip patch antenna element according to claim 1 further comprising means for exciting said tunable microstrip antenna element.

19. The tunable microstrip patch antenna element according to claim 18, wherein said means for exciting comprises a probe that enters the central region of said ground plane and passes into said ground plane then vertically up through and out of said substrate and then into said radiator.

20. The tunable microstrip patch antenna element according to claim 19, wherein said radiator is shaped to have orthogonal edges and has width (w) and length (l) dimensions that are about equal to each other and wherein said means for exciting comprises a plurality of contacts one for each of said orthogonal edges that each enters near the respective orthogonal edge.

21. An antenna system including a plurality of tunable microstrip patch antenna elements each comprising;

a ground plane comprised of a conductive material;

a substrate comprised of a material selected from the group consisting of dielectric and semiconductive materials and mounted on said ground plane;

a radiator having an apparent electrical dimension and with parameters selected so as to operate in a fundamental mode at an odd order common denominator of desired fundamental frequencies, said radiator having a circuit for connecting to a variable bias voltage comprising means for generating a dc electric field between said radiator and said ground plane; and a ferroelectric film placed on said substrate and in cooperation with said substrate being deterministic of said apparent electrical dimension of said radiator.

22. The antenna system according to claim 21, wherein said radiator comprises an annular ring.

23. The antenna system according to claim 21, wherein said substrate is comprised of silicon.

24. The antenna system according to claim 23, wherein said silicon has a resistivity in the range from about 1000 ohm-cm to about 10,000 ohm-cm.

25. The antenna system according to claim 21, further comprising a capacitive coupling arrangement comprising a microstrip spaced apart from said radiator.

26. The antenna system according to claim 21, wherein said circuit comprises a quarter-wavelength radial stub having a vertex which is connected by a high impedance microstrip transmission line to a respective radiator and to a respective means for generating said dc electric field.

27. The antenna system according to claim 26, wherein said respective means for generating said dc electric field is connected to said respective radiator by a wire bond.

28. The antenna system according to claim 27, wherein said means for generating said dc electric field is variable.

29. The antenna system according to claim 21, wherein each tunable microstrip patch antenna element has a desired fundamental frequency and said fundamental mode is $TM_{01}$ with said apparent electrical dimension of the respective radiator having a length which is one-half (½) wavelength long at the respective fundamental frequency.

30. The antenna system according to claim 21, wherein each of said radiator is of a metallic material and has a desired shape.

31. The antenna system according to claim 30, wherein each of said tunable microstrip patch elements has a desired fundamental frequency and wherein said fundamental mode being $TM_{01}$ with said apparent electrical dimension having a length which is one-half (½) wavelength long at the fundamental frequency.

32. The antenna system according to claim 21, wherein each of said tunable microstrip patch antenna elements further comprising means for exciting each of said tunable microstrip antenna elements.

33. The antenna system according to claim 31, wherein each of said means for exciting comprises a probe that enters the central region of each of said ground plane and passes into said ground plane thereof then vertically up through and out of said substrate thereof and then into said radiator thereof.

34. The antenna system according to claim 31, wherein each of said radiators is shaped to have orthogonal edges and has width (w) and length (l) dimensions that are about equal to each other and wherein said means for exciting comprises a plurality of contacts one for each of said orthogonal edges that each enters said ground plane of each radiator near the orthogonal edges.

35. The antenna system according to claim 21, wherein said antenna system is mounted on a surface into a one-dimensional array.

36. The antenna system according to claim 21, wherein said antenna system is mounted on a surface into a two-dimensional array.

37. The antenna system according to claim 21, wherein said antenna system is mounted on a curved surface.

38. A method to provide a tunable microstrip patch antenna element selected to operate at a frequency range having a fundamental frequency thereof comprising the steps of;

providing a ground plane comprised of a conductive material;

providing a substrate comprised of a material selected from the group consisting of dielectric and semiconductive materials and mounted on said ground plane;

providing a radiator having an apparent electrical dimension and with parameters selected so as to operate in a fundamental mode at an odd order common denominator of said fundamental frequency, said radiator having a circuit for connecting to a variable bias voltage comprising means for generating a dc electric field between said radiator and ground plane;

providing a ferroelectric film placed on said substrate and in cooperation with said substrate being deterministic of said apparent electrical dimension of said radiator; and applying and varying said dc electric field so as to tune said radiator over said frequency range.

39. The method according to claim 38, wherein said circuit comprises a quarter-wavelength radial stub having a vertex which is connected by a high impedance microstrip transmission line to said radiator and to said means for generating said electric field.

40. The method according to claim 38, wherein the tunable microstrip patch antenna element has a desired fundamental frequency and said fundamental mode is $TM_{01}$ with said apparent electric dimension comprising a length of said radiator which is about one-half (½) wavelength long at the fundamental frequency.

41. The method according to claim 38, wherein said radiator is of a metallic material and has a desired shape.

42. The method according to claim 38, wherein said tunable microstrip patch antenna element further comprising means for exciting said tunable microstrip antenna element.

43. The method according to claim 42, wherein said means for exciting comprises a probe that enters the central region of said ground plane and passes into said ground plane then vertically up through and out of said substrate and then into said radiator.

44. The method according to claim 42, wherein said radiator is shaped to have orthogonal edges and has width (w) and length (l) dimensions that are about equal to each other and wherein said means for exciting comprises a plurality of contacts one for each of said orthogonal edges that each enters said ground plane near the respective orthogonal edge.

* * * * *